US005944175A

United States Patent [19]

Albisetti

[11] Patent Number: 5,944,175

[45] Date of Patent: Aug. 31, 1999

[54] DEVICE FOR PACKAGING TWO COMPONENTS SEPARATELY, AND A METHOD OF MANUFACTURE

[75] Inventor: Nicolas Albisetti, Clichy, France

[73] Assignee: L'Oreal, Paris, France

[21] Appl. No.: 09/110,260

[22] Filed: Jul. 6, 1998

[30] Foreign Application Priority Data

Jul. 8, 1997 [FR] France ..... 97 08664

[51] Int. Cl.[6] ..... B65D 25/08

[52] U.S. Cl. ..... 206/221; 215/DIG. 8

[58] Field of Search ..... 206/219, 220, 206/221; 215/DIG. 8; 53/285, 287

[56] References Cited

U.S. PATENT DOCUMENTS 5,186,323 2/1993 Pfleger ..... 206/221
5,465,835 11/1995 Schumacher et al. ..... 206/219

FOREIGN PATENT DOCUMENTS 2 506 726 12/1982 France .
2 298 406 9/1996 United Kingdom .

*Primary Examiner*—Jacob K. Ackun
*Attorney, Agent, or Firm*—Oliff & Berridge, PLC

[57] ABSTRACT

The invention relates to a device for separate packaging of two components to be mixed on first use and for dispensing the resulting mixture, the device comprising two superposed containers capable of turning one relative to the other and suitable for communicating with each other, the components being separated during storage by a shutter having a plug connected to a holding member by at least one hinge-forming bridge of material, the device further including drive means for transforming relative rotation of the two containers into displacement of the plug causing the components to be mixed together. The two containers include sealing means independent of the shutter to provide sealing between them. The invention also relates to a method of manufacturing such a device.

17 Claims, 5 Drawing Sheets

DEVICE FOR PACKAGING TWO COMPONENTS SEPARATELY, AND A METHOD OF MANUFACTURE

FIELD OF THE INVENTION

The present invention relates to a device for packaging two components separately, which components are to be mixed on first use, and for dispensing the resulting mixture.

The invention relates more particularly to a device of the type of comprising two superposed containers, which are capable of turning one relative to the other and which are suitable for communicating with each other.

During storage, the components are separated by a shutter which includes a plug connected via at least one bridge of hinge-forming material to a holding member.

This type of device also includes drive means for transforming relative rotation of the two containers into displacement of the plug, causing the components to be mixed together.

BACKGROUND OF THE INVENTION

French patent of invention 2 506 726 in the name of the Applicant company discloses such a device, one of the containers being constituted by a flask having an externally threaded neck. The holding member is constituted by a ring inserted in the neck and bearing against the end wall thereof by means of an annular rim. The other container is constituted by a capsule screwed to the neck, including a central chimney on which the above-mentioned ring is pressed. The shutter comprises a plug closing the chimney during separate storage of the components, and connected to the ring by a bridge of hinge-forming material.

Sealing is provided between the flask and the capsule by the ring being compressed between the neck and the chimney.

Screwing the capsule onto the flask causes the plug to pivot and puts the capsule into communication with the flask. The bridge of hinge-forming material connecting the plug to the ring serves to prevent the plug from dropping to the bottom of the flask.

The ring must be pressed hard against the chimney and the neck in order to achieve the required degree of sealing, thereby impeding the screwing movement of the capsule to a considerable extent, so that the known device is not easy to use.

OBJECTS AND SUMMARY OF THE INVENTION

The invention seeks to provide an improved device, specifically remedying that drawback.

The invention achieves this by the fact that the device includes sealing means that are independent of the shutter for providing sealing between the two containers.

In a particular embodiment of the invention, these sealing means comprise an annular sealing lip formed on one of the containers and coming into sealing contact with the other container.

Still in a particular embodiment of the invention, one of the containers is in the form of a flask having an opening and the other container is in the form of a capsule having an annular sealing lip that presses against the flask in sealed manner.

In a particular embodiment of the invention, the member for holding the shutter is in the form of a ring inserted in the opening of the flask and prevented from rotating relative thereto, having an annular rim bearing against an inside shoulder of said opening, and the capsule has a central chimney extending inside the ring and in which the plug is inserted, the free edge of said chimney forming a helical ramp shaped to bear progressively on the bridge of hinge-forming material during relative rotation of the two containers, so as to cause the plug to pivot away from the chimney.

Preferably, said ramp includes notches in which breakable bridges of material are received connecting the plug to the holding member, so as to break said bridges during relative rotation of the containers.

Also preferably, said ring has external teeth and it is prevented from rotating in the opening of the flask by complementary teeth formed on the inside surface thereof.

In another particular embodiment of the invention, the holding member is in the form of a holding tab prevented from rotating relative to the capsule and received in an annular space formed between the capsule and the flask, and the flask has a helical ramp on its inside surface against which said holding tab bears so that relative rotation between the two containers tends to exert traction on said tab and to displace the plug so as to open the passage between the two containers.

Preferably, the capsule has a notch in which the hinge-forming bridge of material is received that connects the plug to said holding tab, thereby preventing the plug from rotating relative to the capsule.

In another particular embodiment of the invention, the holding member is in the form of a holding tab prevented from rotating relative to the flask and cooperating with the capsule by screw engagement.

Preferably, the flask includes a groove in which the holding tab is received, thereby preventing it from rotating relative to the flask while allowing it to move axially relative thereto during relative rotation of the containers.

In another particular embodiment of the invention, the holding member is in the form of a ring prevented from rotating relative to the flask, and co-operating with the capsule by screw engagement.

The opening of the flask may be constituted by a neck, or in a variant by an open end wall.

The invention also provides a method of manufacturing a packaging device as defined above, wherein the method comprises the steps consisting in:

filling one of the containers;

closing said container by means of the shutter;

filling the other container;

positioning one of the containers on the other; and assembling the two containers together by a simple movement in translation.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
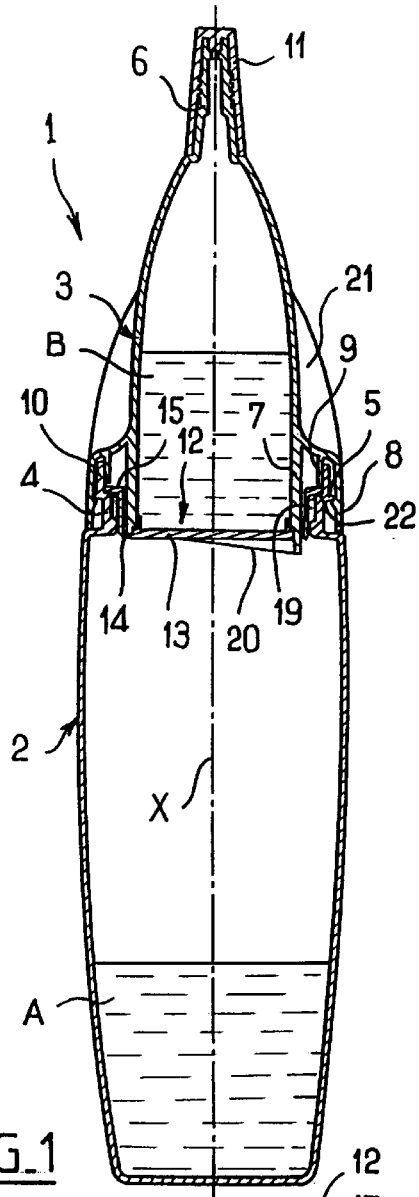
FIG. 1 is a diagrammatic longitudinal section view of a device constituting a first embodiment of the invention, prior to the components being mixed together.
Figure 4:
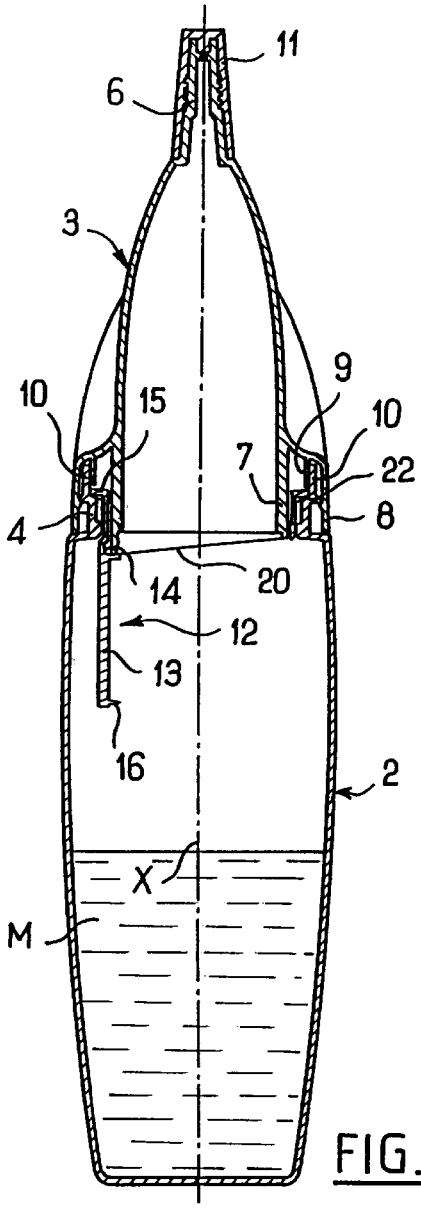
FIG. 4 is a section view analogous to FIG. 1, showing the device after the components have been mixed together.

The packaging device 1 shown in FIGS. 1 and 4 comprises a lower container 2 and an upper container 3 that are capable of turning one relative to the other about a longitudinal axis X of the device.

The lower container 2 is in the form of a flask whose neck 4 includes an outside shoulder 5.

The upper container 3 is in the form of a capsule whose upper portion is shaped with a dispensing endpiece 6 having an external thread onto which a cap 11 is screwed.

The bottom portion of the capsule 3 has a central chimney 7 surrounded by an assembly skirt 8, which skirt is provided on its radially inner surface with an annular bead that snap-fastens against the above-mentioned shoulder 5.

The bottom edge of the assembly skirt 8 rests on the shoulder of the flask situated at the base of the neck 4, such that the capsule 3 is held axially relative to the flask 2.

The capsule 3 also has an annular sealing lip 9 extending down into the annular groove formed between the chimney 7 and the assembly skirt 8.

This sealing lip 9 is circularly symmetrical about the axis X and presses closely against the radially inside surface of the top portion 10 of the neck 4, which surface is likewise circularly cylindrical about the axis X, thereby providing sealing between the capsule 3 and the flask 2.

On the outside, the capsule 3 is provided with ribs 21 for grasping that are designed to make the device easier to handle by the user.

The flask 2 and the capsule 3 are designed to contain two components A and B respectively that need to be stored separately and to be mixed together on first use. The components A and B may be two liquids or a liquid and a powder. By way of example, component A is an oxidizer and component B is a coloring agent which when mixed together to make mixture M constitute hair dye.

A shutter 12 serves to close the chimney 7 while the components A and B are being stored separately.

Figure 2:
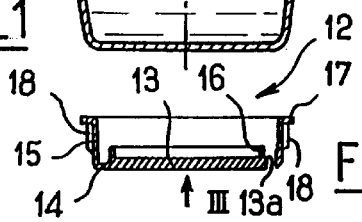
FIG. 2 is an axial view showing, on its own, the shutter fitted the device shown in FIG. 1.
Figure 3:
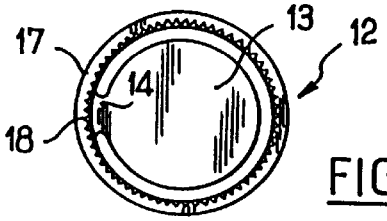
FIG. 3 is a view from beneath as seen along arrow III of FIG. 2.

The shutter 12 is shown on its own in FIGS. 2 and 3 and it comprises a plug 13 connected by a bridge of hinge-forming material 14 to a holding member, which member is constituted in this case by a ring 15 extending inside the neck 4 around the chimney 7.

On its top face, the plug 13 has an annular sealing lip 16 designed to be inserted into the chimney 7 so as to close it in sealed manner.

On examining FIGS. 1 to 4, it will be observed that the periphery of the plug 13 has a shoulder 13*a* for bearing against an inside shoulder of the chimney 7.

The top end of the ring 15 has an annular rim 17 that projects radially outwards and that is designed to bear on an inside shoulder 22 of the neck 4, situated beneath the sealing lip 9.

A plurality of teeth 18 are formed on the radially outer surface of the ring 15 beneath the rim 17 and cooperate with complementary teeth 19 formed on the neck 4 to prevent the ring 15 from rotating relative to the flask 2.

The chimney 7 has a bottom edge constituting a helical ramp 20 extending angularly around the axis X over slightly more than half a turn.

Away from the ramp 20, the bottom edge of the chimney 7 lies in a plane perpendicular to the axis X, and situated slightly above the bridge of material 14.

The capsule 3 and the flask 2 are made of materials that are chemically compatible with the components A and B.

By way of example, the capsule 3 is made of polyvinyl chloride, the flask 2 of polyethylene, and the shutter 12 of polypropylene.

The device 1 is assembled as follows.

The capsule 3 fitted with its cap 2 is filled with the component B and then the plug 13 is inserted into the chimney 7.

Care is taken to offset the ramp 20 angularly from the bridge of material 14.

Thereafter the capsule 3 is inserted in a simple translation movement into the neck 4 of the flask 2 which has previously been filled with component A.

The assembly skirt 8 then snap-fastens onto the neck 4.

Naturally, care is taken to position the teeth 18 on the ring 15 properly relative to the teeth 19 on the neck 4.

To put the capsule 3 into communication with the flask 2 on first use of the device, the user turns the capsule 3 relative to the flask 2 through about half a turn, in the direction which brings the helical ramp 20 to bear progressively downwards on the bridge of material 14.

Since the ring 15 is prevented from rotating relative to the flask and since it is held axially in the neck 4 by the rim 17, this causes the plug 13 to pivot about a geometrical axis of rotation that is perpendicular to the plane of the drawing.

Component B drops into the flask 2 and mixes with component A.

Because the chimney 7 extends to the base of the neck 4, there is no corner in which component B can be retained, so all of it falls into the flask.

This prevents any fraction of component B being dispensed without having previously come into contact with component A.

It will also be observed that the cross-section of the chimney 7 at its bottom end is relatively large, thereby ensuring that component B drops almost instantaneously into the flask, even if it is highly viscous.

The plug 13 is prevented from dropping to the bottom of the flask 2 by the bridge of material 14, and it does not prevent component B from flowing into the flask.

When the mixture M is dispensed, the plug 13 can no longer prevent it from flowing.

It will be observed that once components A and B have been mixed together, it is no longer possible to bring the plug 13 into its initial position by rotating the capsule 3 in the opposite direction.

Given that there is no axial displacement of the capsule 3 relative to the flask 2, it will also be observed that the components are mixed together at constant volume.

This avoids any excess pressure appearing inside the device 1 and any risk of the mixture M squirting out when the cap 11 is removed.

Sealing is provided between the flask 2 and the capsule 3 by the sealing lip 9 without that significantly impeding the rotary movement of the capsule 3 relative to the flask 2.

Furthermore, because of the radial resilience of the sealing lip 9, the flask 2 and the capsule 3 can be made using relatively large manufacturing tolerances.

Figure 5:
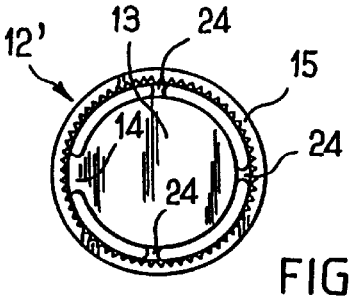
FIG. 5 is a view from beneath showing a variant shutter fitted to a device constituting a second embodiment of the invention.
Figure 6:
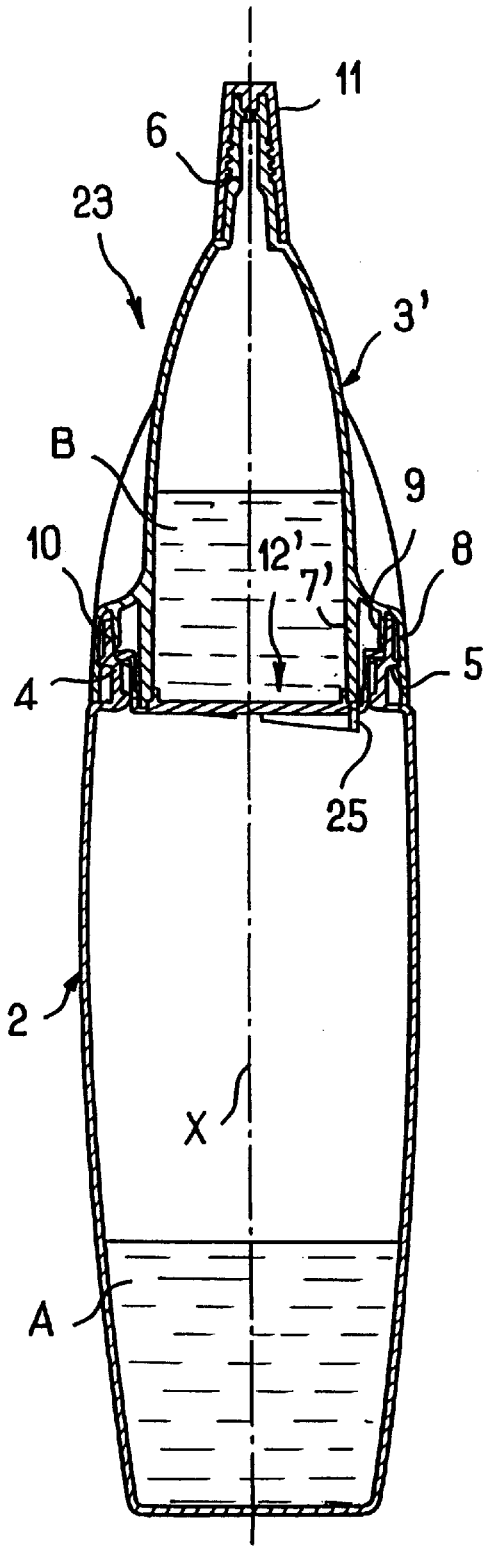
FIGS. 6 and 7 show said device respectively before and after the two containers have been put into communication.
Figure 7:
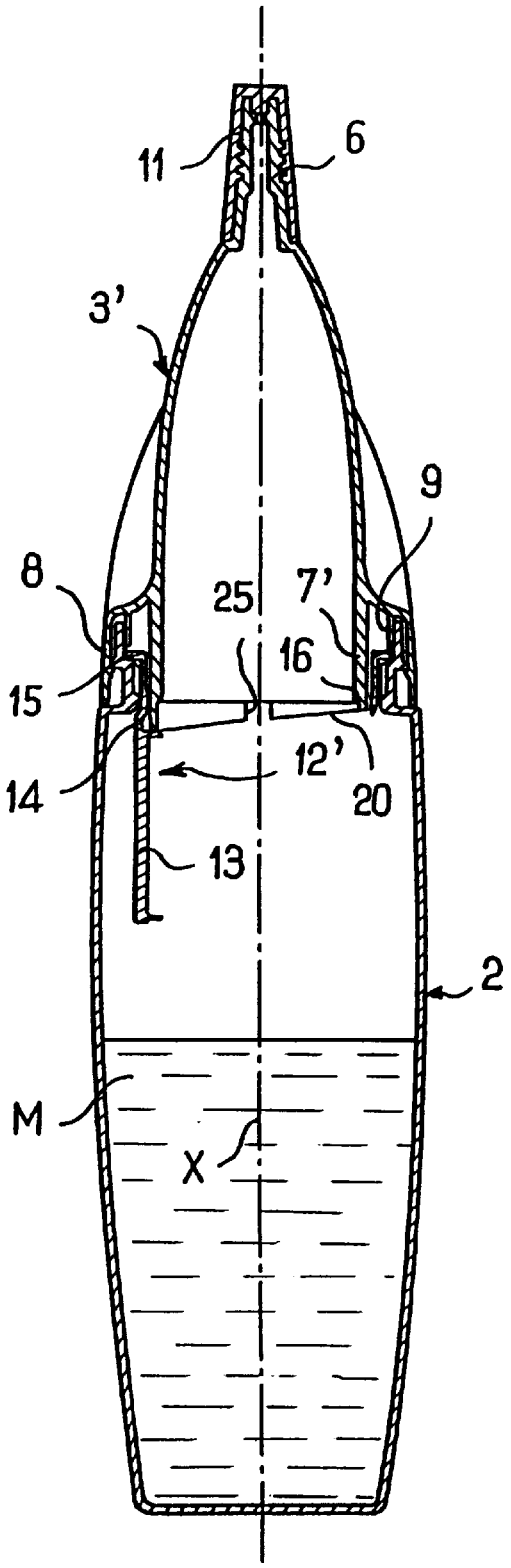

There follows a description, with reference to FIGS. 5 to 7, of a device 23 constituting a second embodiment of the invention, which device differs from the preceding device by the shape of the shutter and by the shape of the bottom end of the central chimney.

The same references are used to designate component parts are identical, and they are not described again.

The shutter of the device 23, referenced 12', differs from the shutter 12 described above by the fact that three bridges of breakable material 24 connect the plug 13 to the ring 15 in addition to the bridge of material 14, as can be seen in FIG. 5.

The capsule of the device 23 is referenced 3' and differs from the capsule 3 described above by the shape of the bottom end of its chimney which is referenced 7'.

Notches 25 are formed in the bottom edge of the chimney 7' to receive the bridges of material 24 when the plug 13 closes the capsule 3'.

During rotation of the capsule relative to the flask 2, thereby pivoting the plug 13 and causing the components A and B to be mixed together, the edges of the notches 25 break the bridges of material 24.

The breaking of these bridges is clearly perceived by the user, thus providing a tamperproofing indicator.

The device 23 has the same advantages as the device 1 described above.

Figure 8:
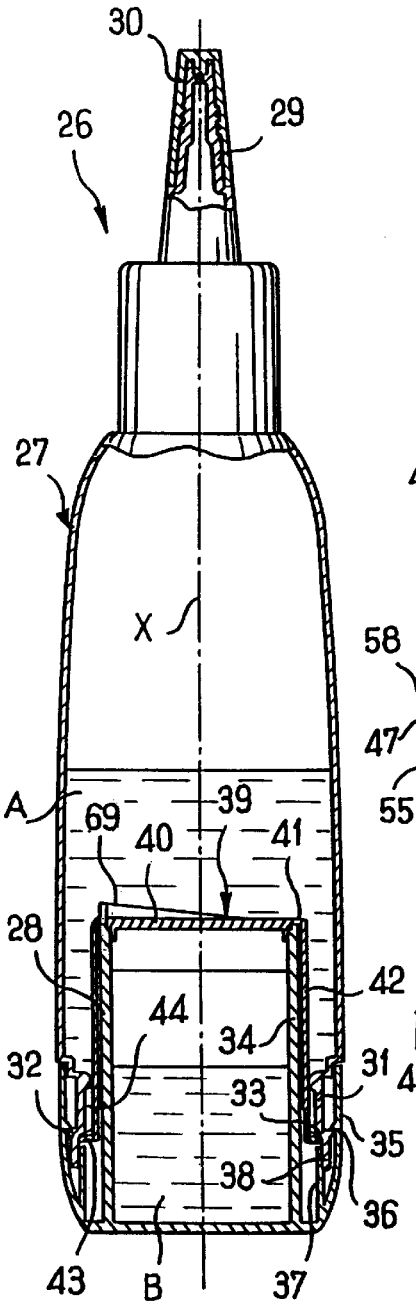
FIG. 8 is a longitudinal section through a device constituting a third embodiment of the invention.

FIG. 8 shows a device 27 constituting a third embodiment of the invention.

The device 26 has an upper container 27 and a lower container 28 capable of turning relative to each other about the longitudinal axis X of the device.

In this case, the upper container 27 is in the form of a flask that has an open bottom, and the lower container 28 is constituted by a punt-forming capsule inserted in the open bottom of the flask.

The top portion of the flask 27 has a threaded dispenser endpiece closed by a removable cap 30.

A narrowing 31 is formed at the bottom portion of the flask 27 to define an outside shoulder 32 and an inside shoulder 33.

The punt 28 has a central chimney 34 surrounded by an assembly skirt 35, which skirt has an annular bead 36 which snap-fastens against the above-mentioned outside shoulder 32.

An annular sealing lip 37 that is circularly symmetrical about the axis X and that is designed to bear in sealed manner against the radially inside surface 38 of the bottom portion of the flask 27 extends upwards between the chimney 34 and the assembly skirt 35.

A shutter 39 enables components A and B contained respectively in the flask 27 and in the chimney 34 to be stored separately before first use of the device 26.

The shutter 39 comprises a plug 40 connected by a hinge-forming bridge of material 41 to a ring 42 which is provided at its bottom end with an annular rim 43 capable of bearing beneath the above-mentioned inside shoulder 33.

Teeth 44 are formed respectively on the ring 42 in the vicinity of the annular rim 43 and on the narrowing 31 so as to prevent the ring 42 from rotating relative to the flask 27.

The shutter 39 is at the top of the chimney while it is in its initial position.

The top edge of the chimney 34 forms a helical ramp 69 making it possible when the punt 28 is rotated relative to the flask 27 to exert thrust progressively upwards on the bridge of material 42 and to cause the plug 40 to pivot upwards, with the ring 42 remaining locked axially in position by the rim 43 being engaged beneath the shoulder 33.

The punt 28 is preferably rotated relative to the flask 27 while the flask is being held underneath, since otherwise some of component A would remain in the annular space situated outside the chimney 34, so mixing with component B would be partial only.

Figure 9:
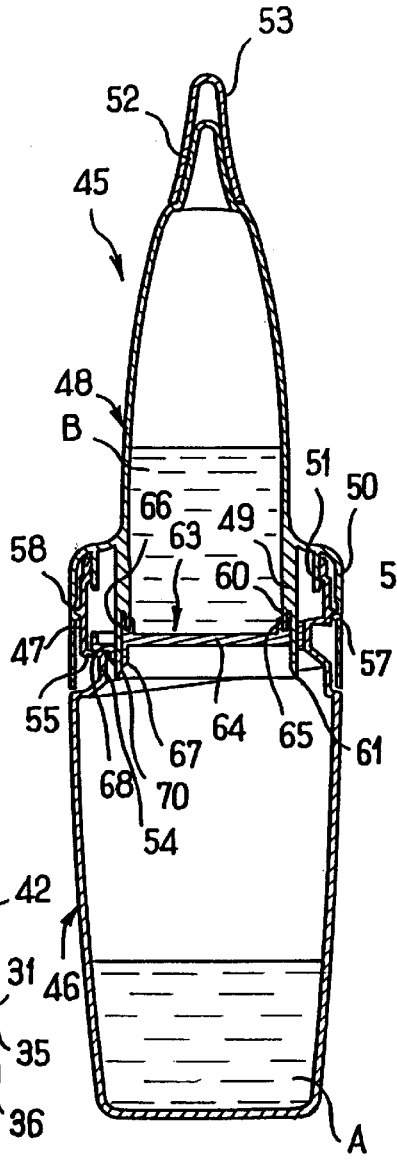
FIGS. 9 and 10 are longitudinal sections through a device constituting a fourth embodiment of the invention, respectively before and after the containers have been put into communication.
Figure 10:
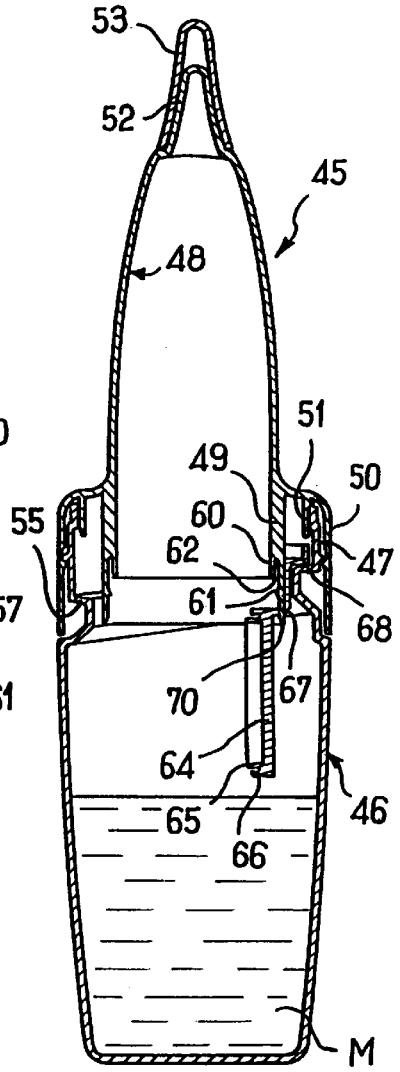

FIGS. 9 and 10 show a device 45 constituting a fourth embodiment of the invention.

This device 45 has a lower container constituted by a flask 46 having a neck 47 and an upper container constituted by a capsule 48 capable of turning relative to the flask 46.

The capsule 48 has a central chimney 49 surrounded by an assembly skirt 50 and between them there is an annular sealing lip 51.

An endpiece 52 for dispensing the mixture M is formed at the top end of the capsule 48. This endpiece 52 is closed by a removable cap 53 which is held in place by friction.

The neck 47 has an outside shoulder 58 against which an annular bead 57 of the assembly skirt 50 snap-fastens.

The sealing lip 51 bears against the radially inside surface of the neck 47 and provides sealing between the capsule 48 and the flask 46.

The bottom portion of the chimney 49 has two concentric walls 60 and 61 forming an annular groove 62 between them.

The radially outer wall 61 extends downwards further than the wall 60.

During storage, the components A and B contained respectively in the flask 46 and the capsule 48 are kept separate by a shutter 63.

The shutter 63 has a plug 64 provided at its periphery with two concentric annular sealing lips 65 and 66 forming a groove into which the wall 60 penetrates when the capsule 48 is closed in sealed manner.

The radially outer lip 66 is then received in the above-mentioned groove 62.

The neck 47 is connected to the remainder of the flask 46 by a narrowing 54 whose top face forms a helical ramp 55.

The plug 64 is connected via a hinge-forming bridge of material 67 to a holding tab 68 which bears against the ramp 55.

The bridge of material 67 rests in the bottom of a notch 70 formed in the wall 61, and having the same length as the notch, such that the plug 64 is prevented from turning relative to the capsule 48.

When the user turns the capsule 48 relative to the flask 46, the shutter 63 is thus rotated therewith.

As the capsule 48 rotates, the holding tab 68 is urged upwards by the ramp 55, thereby exerting traction on the bridge of material 67 tending to cause the plug 64 to pivot downwards and thus disengaging it from the chimney 49 so that it takes up the position shown in FIG. 10, thereby enabling the components A and B to mix together.

Figure 11:
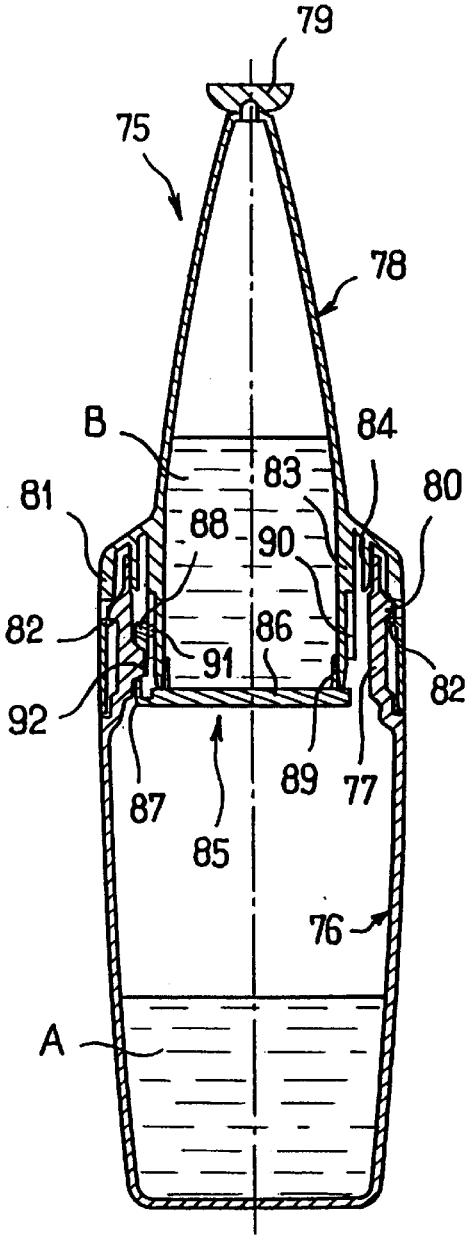
FIG. 11 is a longitudinal section of a device constituting a fifth embodiment of the invention, before the components are mixed.
Figure 13:
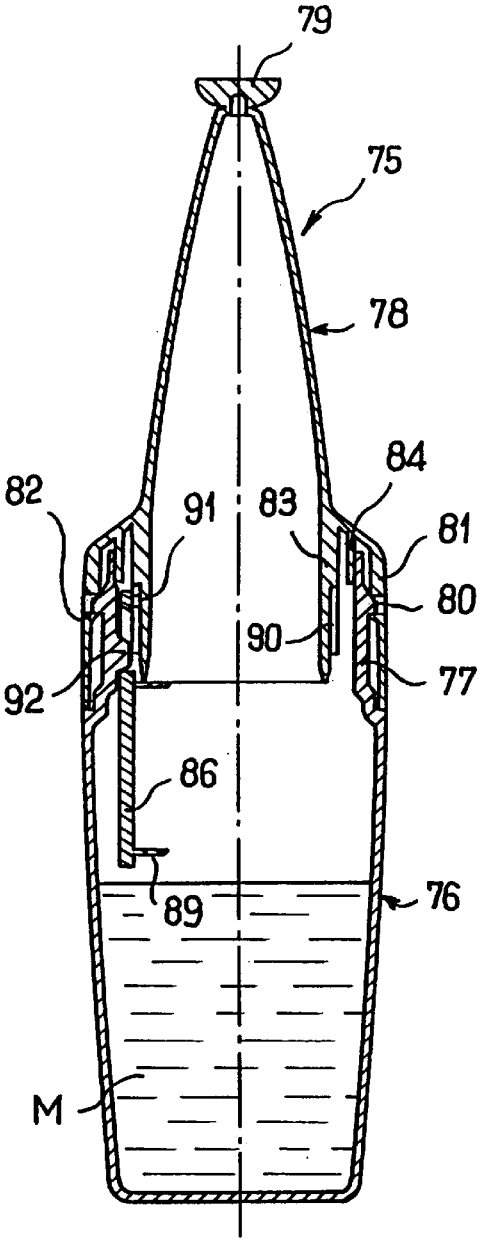
FIG. 13 its a section view analogous to FIG. 11, showing the device after the containers have been put into communication.
Figure 12:
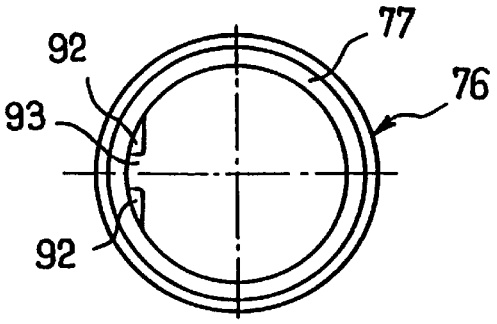
FIG. 12 is a plan view of the lower container of said device, on its own.

FIGS. 11 and 13 show a device 75 constituting a fifth embodiment of the invention.

This device 75 has a lower container constituted by a flask 76 with a neck 77, and an upper container constituted by a capsule 78 that is capable of turning relative to the flask 76.

The top end of the capsule 78 is provided with a snap-off endpiece 79.

The radially outer surface of the neck 77 has an annular bead 80 and the capsule 78 has an assembly skirt 81 provided with pieces in relief 82 surmounted by recesses, each piece in relief 82 occupying slightly more than one-eighth of a turn, for example. The pieces in relief 82 are designed to engage the annular bead 80 in snap-fastening so as to hold capsule 78 axially on the flask 76, while still allowing them to rotate relative to each other.

The capsule 78 has a central chimney 83 extending inside the assembly skirt 81, and it also includes an annular sealing lip 84 between the assembly skirt 81 and the chimney 83, which lip bears against the radially inside surface of the neck 77 to provide sealing between the capsule 78 and the flask 76, as in the preceding embodiments.

The components A and B as contained respectively in the flask 79 and the capsule 78 are kept separate during storage by a shutter 85, which shutter includes a plug 86 connected by a hinge-forming bridge of material 87 to a holding tab 88.

In the vicinity of its periphery, and on its top face, the plug 86 is provided with an annular sealing lip 89 which is inserted into the chimney 83 to close the chimney in sealed manner.

The chimney 83 also has a thread 90 on its radially outside surface, and the holding tab 88 has a thread portion 91 on its radially inside surface engaged in the thread 90.

The neck 77 of the flask 76 also includes, on its inside surface, two bearing surfaces 92 which leave between them a groove 93 in which the holding tab 88 is received.

This prevents the shutter 85 from turning relative to the neck 77 of the flask 76 while enabling the tab 88 to move axially relative to the neck 77 in the groove 93.

When the capsule 78 is rotated relative to the flask 76 in the appropriate direction, the thread portion 91 of the holding tab 88 is urged upwards by the thread 90 of the chimney 83.

The traction which is then exerted on the holding tab 88 tends to cause the plug 86 to pivot downwards about its zone where it presses against the bottom edge of the chimney 83, adjacent to the bridge of material 87.

Figure 14:
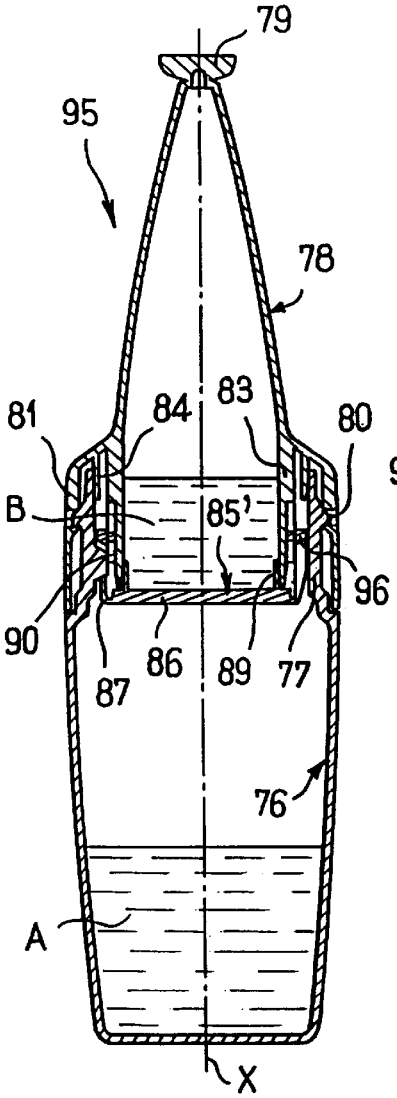
FIG. 14 is a diagrammatic longitudinal section view of a device constituting a sixth embodiment of the invention before the components are mixed.
Figure 16:
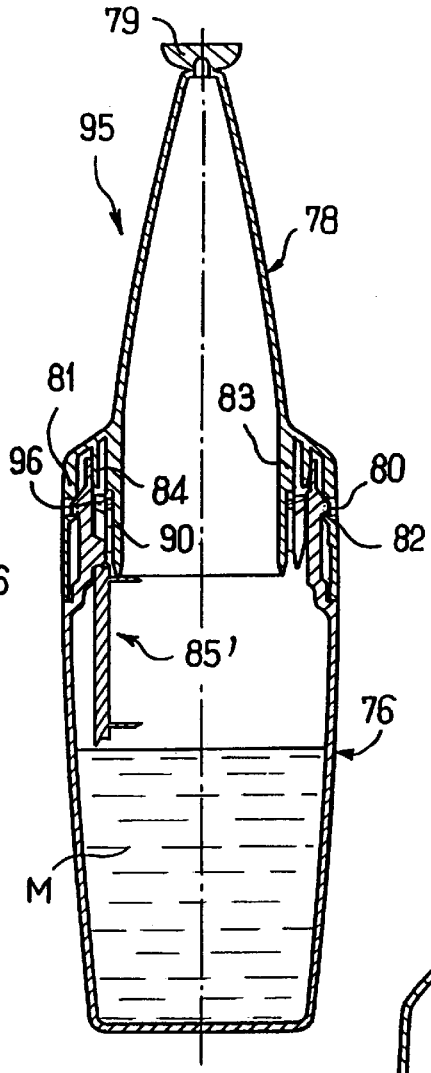
FIG. 16 is a view analogous to FIG. 14, showing the device after the containers have been put into communication.

FIGS. 14 and 16 show a device 95 constituting a sixth embodiment of the invention.

The device 95 comprises a flask 76 and a capsule 78 that are identical to those of the preceding embodiment and that are consequently not described again.

The device 95 differs from the device 75 by the structure of its shutter which is now referenced 85'.

The shutter 85' has a plug 86 connected by a hinge-forming bridge of material 87 to a holding member 96 which is in the form of a ring provided on its radially inside face with four regularly spaced-apart thread portions 97 each extending over an angular sector of about 45°.

The ring 96 is also connected to the plug 86 by three breakable bridges of material 99 that are distributed around its periphery.

When the capsule 78 is rotated relative to the flask 76, the thread portions 97 which are engaged with the thread 90 exert upwardly directed traction which begins by breaking the bridges of material 99 and then causes the plug 86 to pivot about its zone where it presses against the chimney 83, as in the previously described embodiment.

Figure 17:
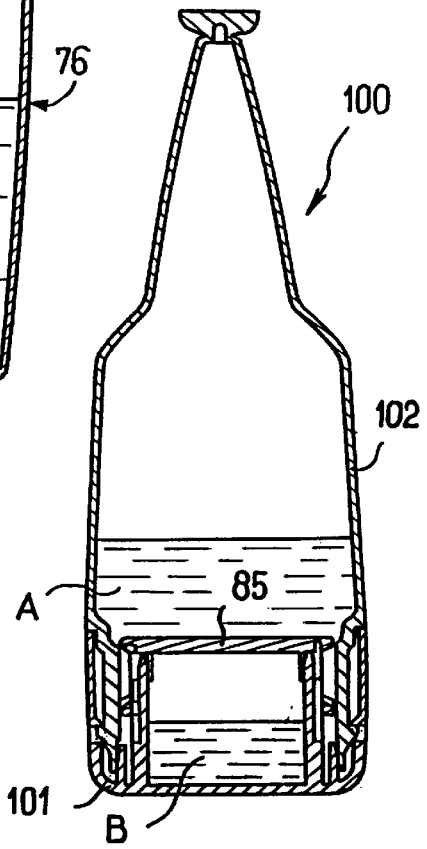
FIG. 17 is a diagrammatic longitudinal section view of a device constituting a seventh embodiment of the invention.
Figure 15:
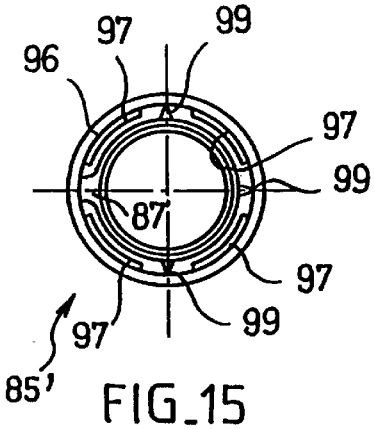
FIG. 15 is a plan view of the shutter fitted to said device.

FIG. 17 shows a device 100 constituting a seventh embodiment of the invention.

The device 100 differs from the above-described device 95 by the shape of its lower and upper containers.

The lower container 101 differs from the above-described capsule 78 in that it has no dispensing endpiece, the endpiece being formed with the flask 102.

In the embodiments described above, it will be observed that the plug begins to move relative to the chimney in which it is inserted under the effect of traction or twisting forces.

This makes it easier to disengage the plug, thus tending to reduce the amount of force that needs to be exerted to mix the components A and B when turning one of the containers relative to the other.

In addition, in the examples described, it will be observed that the containers can easily be assembled together merely by snap-fastening, without there being any need to screw one of the containers relative to the other, and that once assembled together the containers cannot be taken apart by the user.

Furthermore, good sealing is provided between the two containers by means of the invention without that significantly impeding rotary movement of one container relative to the other, unlike the prior art device described in above-mentioned French patent 2 506 726.

The components are mixed together at constant volume, thereby making it possible to avoid squirting, as mentioned above.

Naturally, the invention is not limited to the embodiments described above.

In particular, various characteristics of the embodiments described can be combined to make variants thereof. A device can also be provided that limits angular rotation of one of the components relative to the other.

Thus, the features of the embodiments comprising a flask surmounted by a rotary capsule can be applied to the embodiments comprising a flask with an open bottom provided with a rotary punt, and vice versa.

I claim:

1. A device for separate packaging of two components to be mixed on first use and for dispensing the resulting mixture, the device comprising two superposed containers capable of turning one relative to the other and suitable for communicating with each other, the components being separated during storage by a shutter having a plug connected to a holding member by at least one hinge-forming bridge of material, the device further including drive means for transforming relative rotation of the two containers into displacement of the plug causing the components to be mixed together, wherein the two containers include sealing means independent of the shutter to provide sealing between them.

2. A device according to claim 1, wherein the sealing means comprise an annular sealing lip formed on one of the containers and coming into sealing contact with the other container.

3. A device according to claim 1, wherein said containers are suitable for turning relative to each other without moving axially.

4. A device according to claim 1, wherein said holding member is connected to the plug not only by said hinge-forming bridge of material but also by breakable bridges of material.

5. A device according to claim 1, wherein said holding member is prevented from rotating relative to one of the containers.

6. A device according to claim 1, wherein one of the containers is in the form of a flask having an opening, and wherein the other container is in the form of a capsule having an annular sealing lip that bears in sealed manner against the flask.

7. A device according to claim 6, wherein said holding member is in the form of a ring inserted in the opening of the flask and prevented from rotating relative thereto, bearing via an annular rim on an inside shoulder of said opening, and wherein the capsule has a central chimney extending inside the ring and in which said plug is inserted, the free edge of said chimney forming a helical ramp shaped to bear progressively against said hinge-forming bridge of material during relative rotation of the two containers so as to cause the plug to pivot out from said chimney.

8. A device according to claim 7, wherein said ramp includes notches in which breakable bridges of material are received connecting the plug to the holding member, so as to break said bridges during relative rotation of the containers.

9. A device according to claim 7, wherein said ring has external teeth and is prevented from rotating in the opening of the flask by complementary teeth formed on the inside surface thereof.

10. A device according to claim 6, wherein the holding member is in the form of a holding tab prevented from rotating relative to the capsule and received in an annular space formed between the capsule and the flask, and wherein the flask has a helical ramp on its inside surface against which said holding tab bears so that relative rotation between the two containers tends to exert traction on said tab and to displace the plug so as to open the passage between the two containers.

11. A device according to claim 10, wherein the capsule has a notch in which the hinge-forming bridge of material is received that connects the plug to said holding tab, thereby preventing the plug from rotating relative to the capsule.

12. A device according to claim 6, wherein the holding member is in the form of a holding tab prevented from rotating relative to the flask and co-operating with the capsule by screw engagement.

13. A device according to claim 12, wherein the flask includes a groove in which the holding tab is received, thereby preventing it from rotating relative to the flask while allowing it to move axially relative thereto during relative rotation of the containers.

14. A device according to claim 6, wherein the holding member is in the form of a ring prevented from rotating relative to the flask, and co-operating with the capsule by screw engagement.

15. A device according to claim 7, wherein said opening of the flask is constituted by a neck.

16. A device according to claim 7, wherein said opening of the flask is constituted by an open bottom wall.

17. A method of manufacturing a packaging device as defined in claim 1, wherein the method comprises the steps consisting in:

filling one of the containers;

closing said container by means of the shutter;

filling the other container;

positioning one of the containers on the other; and assembling the two containers together by a simple movement in translation.

* * * * *